US006986702B2

(12) United States Patent
Kamamura et al.

(10) Patent No.: US 6,986,702 B2
(45) Date of Patent: Jan. 17, 2006

(54) CENTERLESS GRINDING APPARATUS AND CENTERLESS GRINDING METHOD

(75) Inventors: Yuko Kamamura, Kanagawa (JP); Hiroyuki Iwanami, Kanagawa (JP)

(73) Assignee: NSK Ltd., Tokyo (JP)

( * ) Notice: Subject to any disclaimer, the term of this patent is extended or adjusted under 35 U.S.C. 154(b) by 0 days.

(21) Appl. No.: 10/405,503

(22) Filed: Apr. 3, 2003

(65) Prior Publication Data

US 2003/0236058 A1 Dec. 25, 2003

(30) Foreign Application Priority Data

Apr. 3, 2002 (JP) ..... P.2002-101281

(51) Int. Cl.
*B24B 49/00* (2006.01)

(52) U.S. Cl. ..... 451/11; 451/188; 451/189

(58) Field of Classification Search ..... 451/11, 451/65, 182, 188, 189, 242, 283, 406, 407
See application file for complete search history.

(56) References Cited

U.S. PATENT DOCUMENTS 3,874,128 A * 4/1975 Ishii ..... 451/397
4,497,138 A * 2/1985 Schreiber ..... 451/65
4,616,448 A * 10/1986 Nagata ..... 451/335
2002/0115391 A1 * 8/2002 Yamaguchi et al. ..... 451/49

FOREIGN PATENT DOCUMENTS

| | | |
|---|---|---|
| EP | 0548957 A1 * | 6/1993 |
| JP | 62-58870 B | 12/1987 |
| JP | 6-339842 | 12/1994 |
| JP | 8-197391 | 8/1996 |
| JP | 2678144 | 7/1997 |
| JP | 9-267242 * | 10/1997 |

* cited by examiner

*Primary Examiner*—M. Rachuba
(74) *Attorney, Agent, or Firm*—Sughrue Mion, PLLC

(57) ABSTRACT

A centerless grinding apparatus (10) includes an outer diameter surface grinding wheel (11) for grinding the outer diameter surface of a work (1) of a substantially cylindrical shape, a regulating wheel (12) for supporting the outer diameter surface of the work (1) in conjunction with the outer diameter surface grinding wheel (11) and an end surface grinding wheel (21) for grinding the end surface of the work (1). The end surface grinding wheel (21) grinds the end surface of the work (1) while the outer diameter surface grinding wheel (11) grinds the outer diameter surface of the work (1) in a state that the work (1) is disposed between the outer diameter surface grinding wheel (11) and the regulating wheel (12).

7 Claims, 9 Drawing Sheets

CENTERLESS GRINDING APPARATUS AND CENTERLESS GRINDING METHOD

BACKGROUND OF THE INVENTION

1. Field of the Invention

The present invention relates to an in-feed type centerless grinding apparatus.

2. Description of the Related Art

For example, the centerless grinding apparatuses used for manufacturing the rollers of rolling bearings are classified into an in-feed type, a through-feed type and a tangential-type.

According to the in-feed type, a work is ground in a predetermined shape by radially feeding a grinding wheel or a regulating wheel in a state where the work is set in a grinding space between the rotating grinding wheel and the rotating regulating wheel.

Conventionally, the outer diameter surface and the end surface of a work are ground by separate grinding apparatuses, respectively, in a manner that the work subjected to the heat treatment is first ground at its outer diameter surface and then ground at its end surface. Further, as to a work required for a high accuracy, in order to obtain the sufficient accuracy of the end surface serving as the reference at the time of grinding the outer diameter surface, the end surface is ground after grinding the outer diameter surface and further the outer diameter surface is subjected to the finish grinding.

JP-B-62-58870 and Japanese Patent No 2678144 disclose a technique for simultaneously grinding the outer diameter surface and the inner diameter surface of an annular work.

JP-A-6-339842 discloses an apparatus for grinding the inner diameter surface and the end surface of an annular work. This apparatus is arranged in a manner that a grinding wheel for grinding the inner diameter surface is disposed at a first grinding processing position and a grinding wheel for grinding the end surface is disposed at a second grinding processing position, whereby a work is sequentially indexed at the two grinding processing positions thereby to sequentially grind the inner diameter surface and the end surface.

There has been desired a grinding apparatus which can simultaneously grind the outer diameter surface and the end surface of a work so that the rollers of a rolling bearing etc. can be ground quickly.

None of JP-B-62-58870 and Japanese Patent No 2678144 discloses a technique for grinding the end surface of a work.

According to the apparatus described in JP-A-6-339842, although both the inner diameter surface and the end surface of the work can be processed with one-time chucking, it is impossible to simultaneously grind both the outer diameter surface and the end surface of the work since a chuck interferes with the grinding wheel.

SUMMARY OF THE INVENTION

Accordingly, the invention has been made in view of the aforesaid circumstance of the conventional techniques and an object of the invention is to provide a centerless grinding apparatus and a centerless grinding method which can simultaneously grind the outer diameter surface and the end surface of a substantially cylindrical work despite of a relatively simple configuration of the apparatus.

The object of the invention can be attained by the following configuration.

(1) A centerless grinding apparatus includes an outer diameter surface grinding wheel for grinding an outer diameter surface of a work of a substantially cylindrical shape, a regulating wheel for supporting the outer diameter surface of the work together with the outer diameter surface grinding wheel and an end surface grinding wheel for grinding an end surface of the work, wherein the end surface grinding wheel grinds the end surface of the work while the outer diameter surface grinding wheel grinds the outer diameter surface of the work in a state that the work is disposed between the outer diameter surface grinding wheel and the regulating wheel.

(2) The centerless grinding apparatus described in (1), wherein the outer diameter surface grinding wheel is formed in a disc shape, and the outer diameter surface of the work is ground by an outer periphery of the outer diameter surface grinding wheel.

(3) The centerless grinding apparatus described in (1) or (2), wherein the end surface grinding wheel is a cup grinding wheel which grinds the end surface of the work while avoiding interference with the outer diameter surface grinding wheel.

(4) The centerless grinding apparatus described in (3) wherein the cup grinding wheel is disposed in a manner that an extended line of a rotation axis of the cup grinding wheel crosses with an extended line of a rotation axis of the work in a state of being supported between the outer diameter surface grinding wheel and the regulating wheel thereby to grind the end surface of the work in a spherical shape.

(5) The centerless grinding apparatus described in (3) or (4), further includes a dressing device for dressing the cup grinding wheel in a tapered shape or a spherical shape.

(6) The centerless grinding apparatus described in (1) or (2) , wherein the end surface grinding wheel is formed in a disc shape, and the end surface of the work is ground by an outer periphery of the end surface grinding wheel while avoiding interference with the outer diameter surface grinding wheel.

(7) The centerless grinding apparatus described in one of (1) to (6), wherein the regulating wheel applies to the work a driving force directed toward the end surface grinding wheel while supporting the outer diameter surface of the work together with the outer diameter surface grinding wheel.

(8) A centerless grinding method includes supporting an outer diameter surface of a work of a substantially cylindrical shape by an outer diameter surface grinding wheel and a regulating wheel; and grinding an end surface of the work by an end surface grinding wheel while and grinding the outer diameter surface of the work by the outer diameter surface grinding wheel in a state that the supporting is maintained, wherein grinding of the end surface of the work is started upon a lapse of a predetermined time after grinding of the outer diameter surface of the work is started.

(9) The centerless grinding method described in (8), wherein the grinding of the end surface of the work is terminated before the grinding of the outer diameter surface of the work is terminated.

(10) The centerless grinding method described in (8) or (9), wherein each of the outer diameter surface grinding process and the end surface grinding process includes a rough cutting process and a finish cutting process, and the rough cutting process of the end surface grinding process is terminated before the rough cutting process of the outer diameter surface grinding process is terminated.

In the aforesaid configuration, at the time of grinding the outer diameter surface of the work by the outer diameter surface grinding wheel while supporting the outer diameter surface of the work by the outer diameter surface grinding wheel and the regulating wheel, the end surface grinding of the work is carried out by utilizing that the movement of the work in the axial direction thereof is suppressed. Thus, the outer diameter surface and the end surface of the work can be ground simultaneously without changing the positions for grasping the work or indexing the work to different grinding processing positions. According to the invention, the configuration of the apparatus can be simplified, a time period required for the grinding process can be shortened and the processing cost can be reduced. Further, it becomes possible to process with a higher accuracy.

There are a conical roller of a rolling bearing, a self-aligning roller, for example, as a work of a substantially cylindrical shape.

DETAILED DESCRIPTION OF THE PREFERRED EMBODIMENTS

The embodiment of the invention will be explained with reference to the accompanying drawings.

Figure 1:
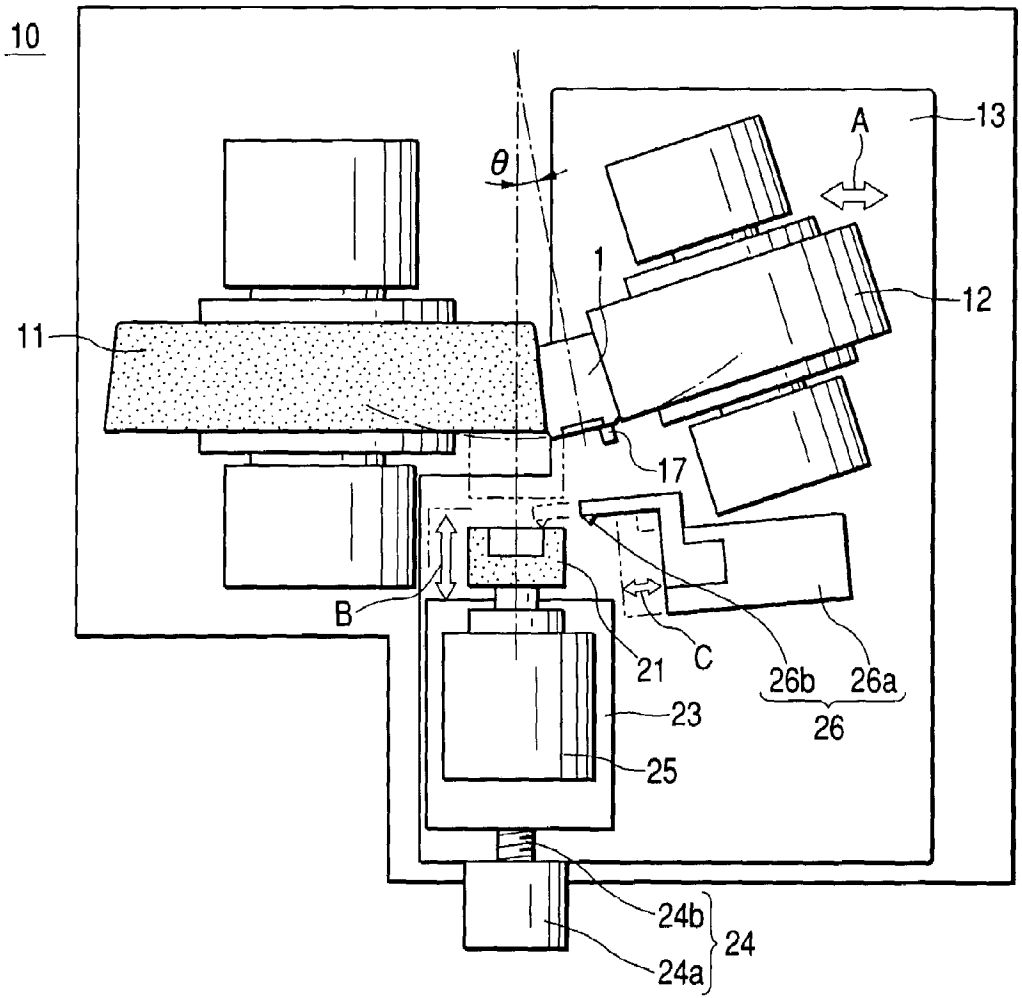
FIG. 1 is a schematic plan view showing a first embodiment of the invention.

FIG. 1 is a schematic plan view of a centerless grinding apparatus 10 according to the first embodiment of the invention. The centerless grinding apparatus 10 is suitable for grinding a work such as a conical roller 1 etc. A first grinding mechanism for grinding the outer diameter surface of a work 1 includes an outer diameter surface grinding wheel 11 formed in a disc shape, a regulating wheel 12, an outer diameter surface cutting table 13 for approaching and separating the regulating wheel 12 to and from the outer diameter surface grinding wheel 11, respectively, a supporting blade for supporting the work 1 from the lower side thereof (support the work 1 from the rear side of the drawing sheet) and a dressing device (not shown) for the outer diameter surface grinding wheel 11 and the regulating wheel 12. These constituent elements are also provided at the usual in-feed centerless grinding machine.

The centerless grinding apparatus 10 according to the embodiment includes a second grinding mechanism for grinding the end surface of the work 1 (the large diameter side end surface of the conical roller in this case) , which has a cup grinding wheel 21 serving as an end surface grinding wheel, an end surface cutting table 23 for approaching and separating the cup grinding wheel 21 to and from the end surface of the work 1, respectively, and a dressing device 26 for the cup grinding wheel 21.

The outer peripheral surface of the outer diameter surface grinding wheel 11 is formed in a conical shape so as to be slightly slanted with respect to the rotation axis of the outer diameter surface grinding wheel 11 so that the extended line of the rotation axis of the work 1 crosses at a desired distance with the extended line of the rotation axis of the cup grinding wheel 21 for grinding the end surface as described later. According to the embodiment, the rotation axis of the outer diameter surface grinding wheel 11 is directed to the horizontal direction (a direction in parallel to the installation surface of the apparatus).

The outer periphery of the regulating wheel 12 is formed in a cylindrical shape in parallel to the rotation axis of the regulating wheel 12. The outer diameter surface cutting table 13 is moved substantially linearly as shown by an arrow A in FIG. 1 thereby to approach and separate the regulating wheel 12 to and from the outer diameter surface grinding wheel 11, respectively, while maintaining the crossing angle between the rotation axis of the regulating wheel 12 and the rotation axis of the outer diameter surface grinding wheel 11 substantially constant.

The work 1 is disposed between the outer periphery of the outer diameter surface grinding wheel 11 and the outer periphery of the regulating wheel 12. In this case, the conical roller 1 is sandwiched between the outer periphery of the outer diameter surface grinding wheel 11 and the outer periphery of the regulating wheel 12 so that the large diameter side end surface of the conical roller 1 slightly protrudes from the large diameter side end surface of the outer diameter surface grinding wheel 11. In this state, the outer diameter surface of the conical roller 1 is ground by the outer diameter surface grinding wheel 11.

According to the embodiment, the second grinding mechanism is disposed on a side where the large diameter side end surface of the work 1 is disposed on the outer diameter surface cutting table 13. The extended line of the rotation axis of the cup grinding wheel 21 crosses with the extended line of the rotation axis of the work 1 (with a crossing angle θ) in a state of being sandwiched between the outer diameter surface grinding wheel 11 and the regulating wheel 12. The crossing angle θ is set in a manner that a distance from the crossing point to the end surface of the work 1 coincides with a desired curvature radius of the end surface. The second grinding mechanism for grinding the end surface is disposed on the outer diameter surface cutting table like a work rest, so that even when the diameter of the outer diameter surface grinding wheel 11 or the regulating wheel 12 changes by the dressing operation, the similar end surface grinding can be realized without changing the positional relation with the work 1.

The end surface cutting table 23 is moved linearly as shown by an arrow B in FIG. 1 thereby to approach and separate the cup grinding wheel 21 to and from the respective large diameter side end surfaces of the work 1 and the outer diameter surface grinding wheel 11, while maintaining the crossing angle θ between the extended line of the rotation axis of the cup grinding wheel 21 and the extended line of the rotation axis of the work 1 substantially constant. The end surface cutting table 23 is moved linearly by a linear guide device 24 having a feed motor 24*a* and a feed screw 24*b* directly coupled to the feed motor 24*a*. The cup grinding wheel 21 is rotated by a spindle 25 provided on the end surface cutting table 23.

The cup grinding wheel 21 can be dressed by the dressing device 26 in a state that the cup grinding wheel 21 is separated from the respective large diameter side end surfaces of the work 1 and the outer diameter surface grinding wheel 11. The dressing device 26 includes a grinding wheel dressing slide 26*a* and a grinding wheel dressing diamond 26*b* provided at the tip end of an arm on the grinding wheel dressing slide 26*a*. The grinding wheel dressing slide 26*a* is moved linearly as shown by an arrow C in FIG. 1, and at this time the grinding wheel dressing diamond 26*b* dresses the cup grinding wheel 21 in a tapered shape.

Although not shown, the dressing operations of the outer diameter surface grinding wheel 11 and the regulating wheel 12 are performed like the usual in-field centerless grinding machine.

The cup grinding wheel 21 abuts against a portion closer to the outer diameter surface grinding wheel 11 of the large diameter side end surface of the work 1, and in this state, each of the work 1 and the cup grinding wheel 21 rotates thereby to grind the end surface of the work 1.

On the other hand, an end surface stopper 17 abuts against a portion closer to the regulating wheel 12 of the large diameter side end surface of the work 1 thereby to support the end surface of the work 1. The regulating wheel 12 having the rotation axis slanted (that is, skewed) with respect to the rotation axis of the work 1 applies to the work 1 a thrust force in the axial direction directed toward the end surface stopper 17 side thereby to urge the work 1 against the end surface stopper 17. In this state, the cup grinding wheel 21 grinds the end surface of the work 1.

According to the embodiment, since the cup grinding wheel 21 is disposed in a manner that the extended line of the rotation axis thereof crosses with the extended line of the rotation axis of the work 1 in a sandwiched state between the outer diameter surface grinding wheel 11 and the regulating wheel 12, so that the end surface of the work 1 can be ground in a spherical shape. The curvature radius of the end surface of the work 1 can be adjusted by adjusting the crossing angle θ between the extended line of the rotation axis of the cup grinding wheel 21 and the extended line of the rotation axis of the work 1 (that is, by changing the slanted angle of the conical-shaped outer periphery of the outer diameter surface grinding wheel 11).

Figure 2:
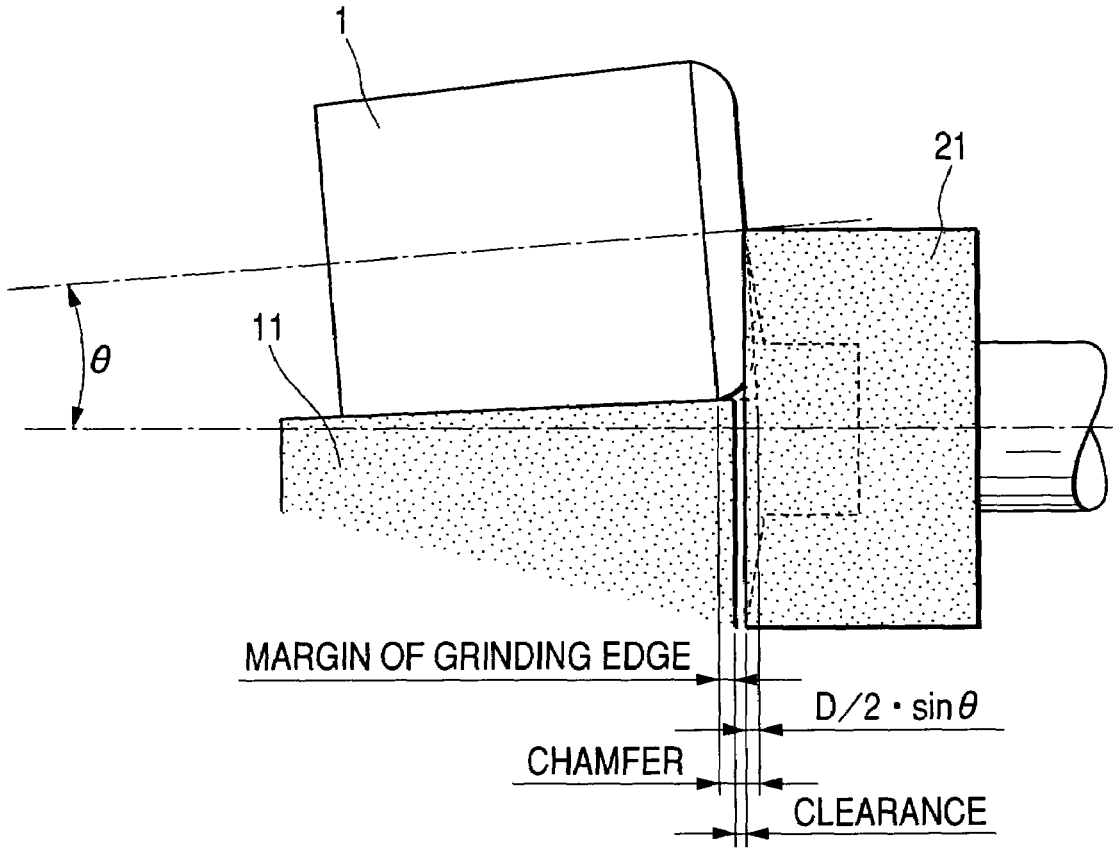
FIG. 2 is an enlarged diagram showing the main portion of the first embodiment.

As shown in an enlarged manner in FIG. 2, the chamfer portion of the work 1 is not ground. That is, the chamfer portion of the work 1 protrudes in the axial line direction from the large diameter side end surface of the outer diameter surface grinding wheel 11, whereby a clearance can be secured so that the outer diameter surface grinding wheel 11 does not interfere with the cup grinding wheel 21 to each other.

The clearance is obtained as represented by the following expression when taking a margin due to sag in the vicinity of the edge of the outer diameter surface grinding wheel 11 into consideration:

$$\text{clearance}=\text{chamfer}-D/2\sin\theta-\text{margin of the grinding stone edge},$$

where D represents the large diameter side end surface of the work 1.

Figure 3:
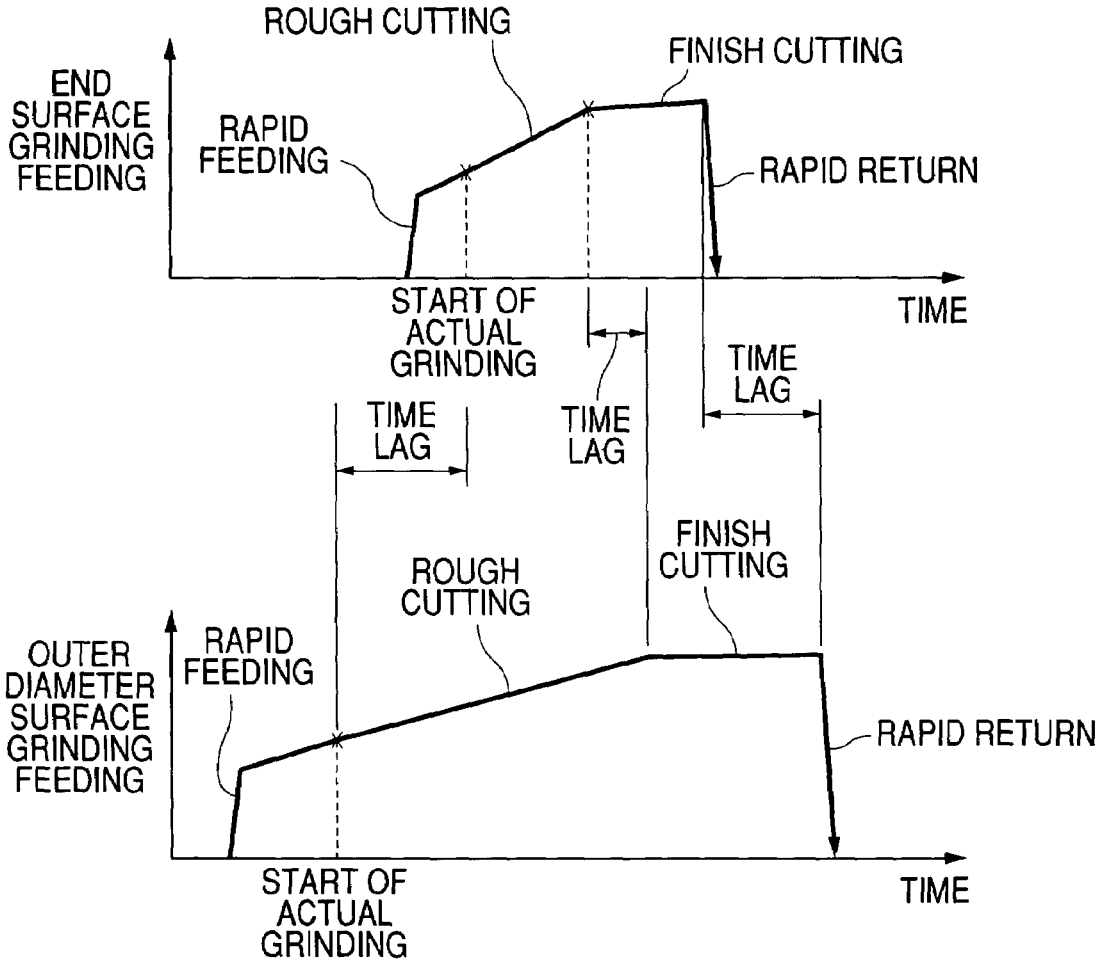
FIG. 3 is a timing chart for explaining the grinding operation of the first embodiment.

At the time of grinding the end surface, since the work 1 is required to be clamped between the outer diameter surface grinding wheel 11 and the regulating wheel 12, the grinding process is set as shown in FIG. 3. That is, after the rapid feeding for the outer diameter surface grinding, a rough cutting process for the outer diameter surface grinding is started. Then, when the outer diameter surface grinding is actually started and then the work 1 is sufficiently clamped by the grinding force, the end surface grinding is started. In other words, after the lapse of a predetermined time from the start of the actual grinding of the outer diameter surface, the actual grinding of the end surface is started. That is, after the rapid feeding for the end surface grinding, a rough cutting process for the end surface grinding is started. Then, the end surface grinding is actually started after the lapse of the predetermined time from the start of the actual grinding of the outer diameter surface.

The grinding process is set such that the end surface grinding is terminated before the termination of the grinding of the outer diameter surface. In each of the outer diameter surface grinding and the end surface grinding, a finish cutting process is carried out after the rough cutting process. In this respect, the grinding force differs between the finish cutting process and the rough cutting process. It is desirable to set the grinding condition in a manner that the rough cutting process for the end surface grinding is terminated before the termination of the rough cutting process for the outer diameter surface grinding. That is, it is desirable to start the finish cutting process for the outer diameter surface grinding after the lapse of a predetermined time from the start of the finish cutting process for the end surface grinding.

Further, it is desirable to terminate the finish cutting process for the outer diameter surface grinding after the lapse of a predetermined time from the termination of the finish cutting process for the end surface grinding.

Figure 4B:
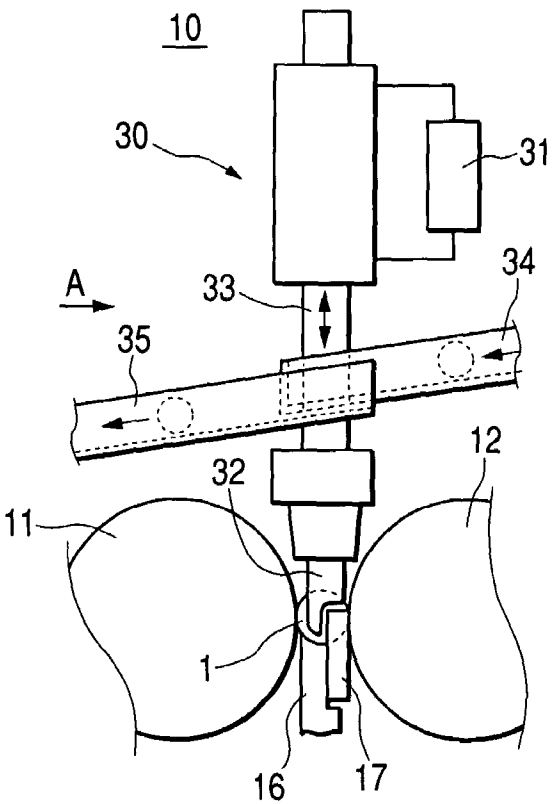
FIGS. 4A and 4B are schematic side views showing the main portion of the first embodiment.
Figure 4A:
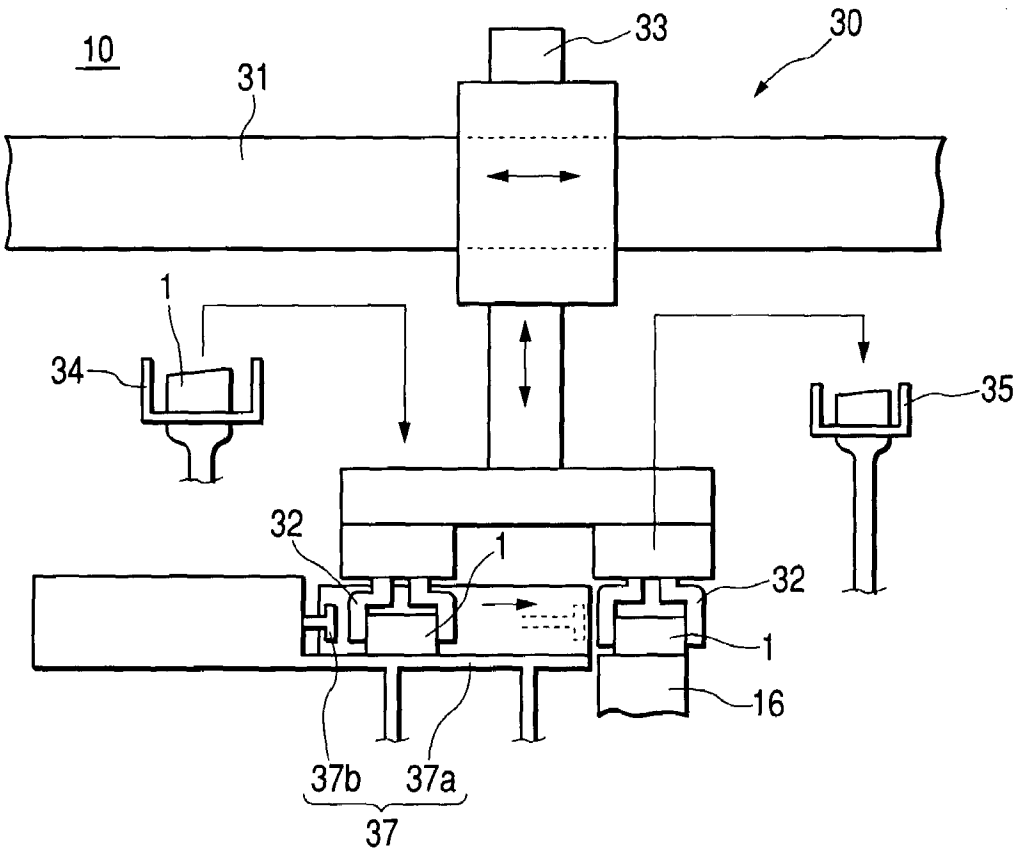

FIG. 4B is a schematic side view of the centerless grinding apparatus 10. FIG. 4A is a diagram seen from an arrow A direction in FIG. 4B.

As shown in FIG. 4B, the work 1 is supported at its outer diameter surface from the both side directions by the outer periphery of the outer diameter surface grinding wheel 11 and the outer periphery of the regulating wheel 12, supported at its outer diameter surface from the lower direction by a supporting blade 16 and also supported at its end surface by the end surface stopper 17.

The centerless grinding apparatus 10 is provided with a loading mechanism 30. The loading mechanism 30 includes a loader rail 31 extended in the horizontal direction, an elevational arm 33 which is moved in the horizontal direction on the loader rail 31 and moves hands 32 upward and downward, an inshoot 34 and an outshoot 35. The loading mechanism 30 further includes a guide 37 as shown in FIG. 4A which is disposed in a parallel relation in the horizontal direction at the inner side (a side where the end surface grinding stone is not provided) of the supporting blade 16 between the outer diameter surface grinding wheel 11 and the regulating wheel 12. The guide 37 includes a guide rail 37*a* and a pusher 37*b*.

As shown in FIG. 4A, the elevational arm 33 is provided with two hands 32, 32 which are spaced in the horizontal direction. These hands 32, 32 are moved simultaneously in the horizontal direction and also moved simultaneously in the upward and downward direction.

First, one of the hands 32 (the left side hand in the drawing) takes out the work 1 from the inshoot 34 and places the work on the guide rail 37*a*, and simultaneously the other hand 32 (the right side hand in the drawing) clamps the work 1 having been ground and placed on the supporting blade 16. Thereafter, the hand is moved upward thereby to place the work 1 having been ground on the outshoot 35. After the hands 32, 32 are moved upward, the pusher 37*b* sets the work 1 placed on the guide rail 37*a* to a grinding position on the supporting blade 16. At this time, the regulating wheel 12 is moved away in advance. When the work 1 is pushed out to the grinding position and placed in a stable state, the grinding operation is started. Together with the grinding operation, the one hand 32 clamps the work 1 on the inshoot 34 side for the preparation of the next loading, and waits for the termination of the grinding operation.

Next, a centerless grinding apparatus 40 according to the second embodiment of the invention will be explained based on FIGS. 5A and 5B. Now, in the embodiment explained below, parts etc. having the similar constructions and operations to the parts etc. described above are marked with the same or corresponding references, and therefor the explanations thereof are simplified or omitted.

Figure 5A:
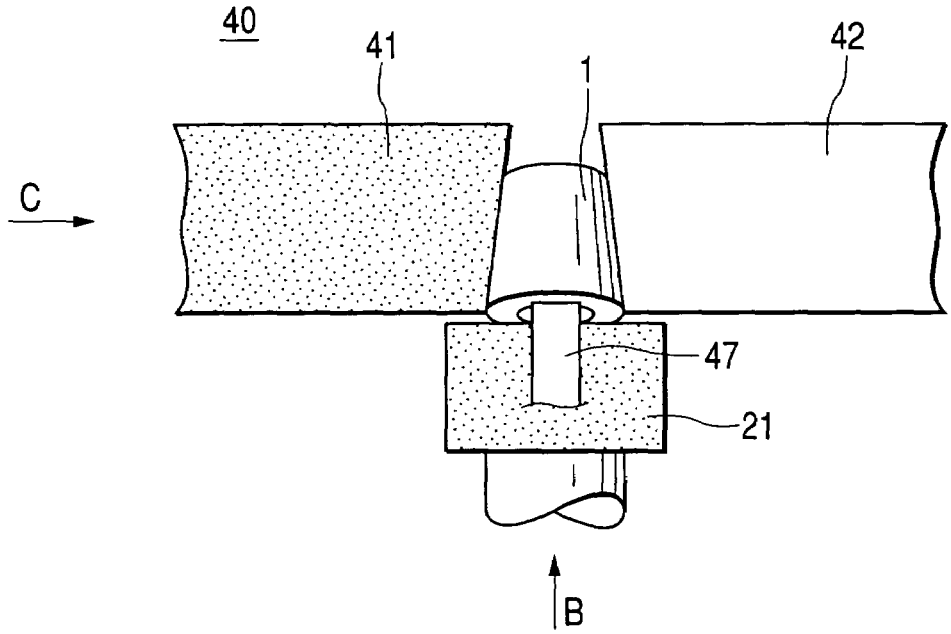
FIGS. 5A and 5B are enlarged diagrams showing the main portion of a second embodiment.

FIG. 5A is a schematic plan view showing the main portion of the centerless grinding apparatus 40. FIG. 5B is a diagram seen from an arrow B direction in FIG. 5A. The outer periphery of a regulating wheel 42 is formed in a conical shape (or a hourglass-shape) like the outer periphery of an outer diameter surface grinding wheel 41. A work (conical roller) 1 is disposed between the outer periphery of the outer diameter surface grinding wheel 41 and the outer periphery of the regulating wheel 42. A cup grinding wheel 21 serving as an end surface grinding wheel and an end surface stopper 47 are disposed in a substantially axial direction of the work 1. The rotation axis of the cup grinding wheel 21 is directed to the horizontal direction.

The extended line of the rotation axis of the work 1 crosses with the extended line of the rotation axis of the cup grinding wheel 21 in a state that the work 1 is supported by the outer diameter surface grinding wheel 41 and the regulating wheel 42. That is, the work 1 is sandwiched between the outer diameter surface grinding wheel 41 and the regulating wheel 42 in a state that the work 1 is slanted with respect to the horizontal direction such that the large diameter side end surface side of the work is disposed at a higher-position, whereby the lower side portion of the large diameter side end surface of the work 1 is ground by the cup grinding wheel 21. The end surface stopper 47 supports the upper side portion of the large diameter side end surface of the work 1.

Figure 5B:
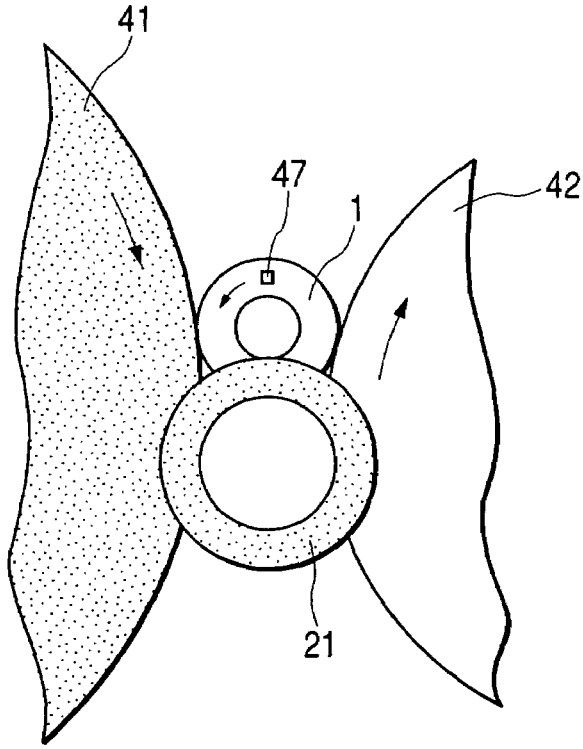

When seen from the side direction as shown in FIG. 5B, the work 1 and the cup grinding wheel 21 are disposed on the same line between the outer diameter surface grinding wheel 41 and the regulating wheel 42 at different positions such that both of them are partially overlapped. When the outer diameter surface grinding wheel 41 and the regulating wheel 42 rotate in the same direction (in the clockwise direction in the figure), the work 1 rotates in the opposite direction.

Figure 6:
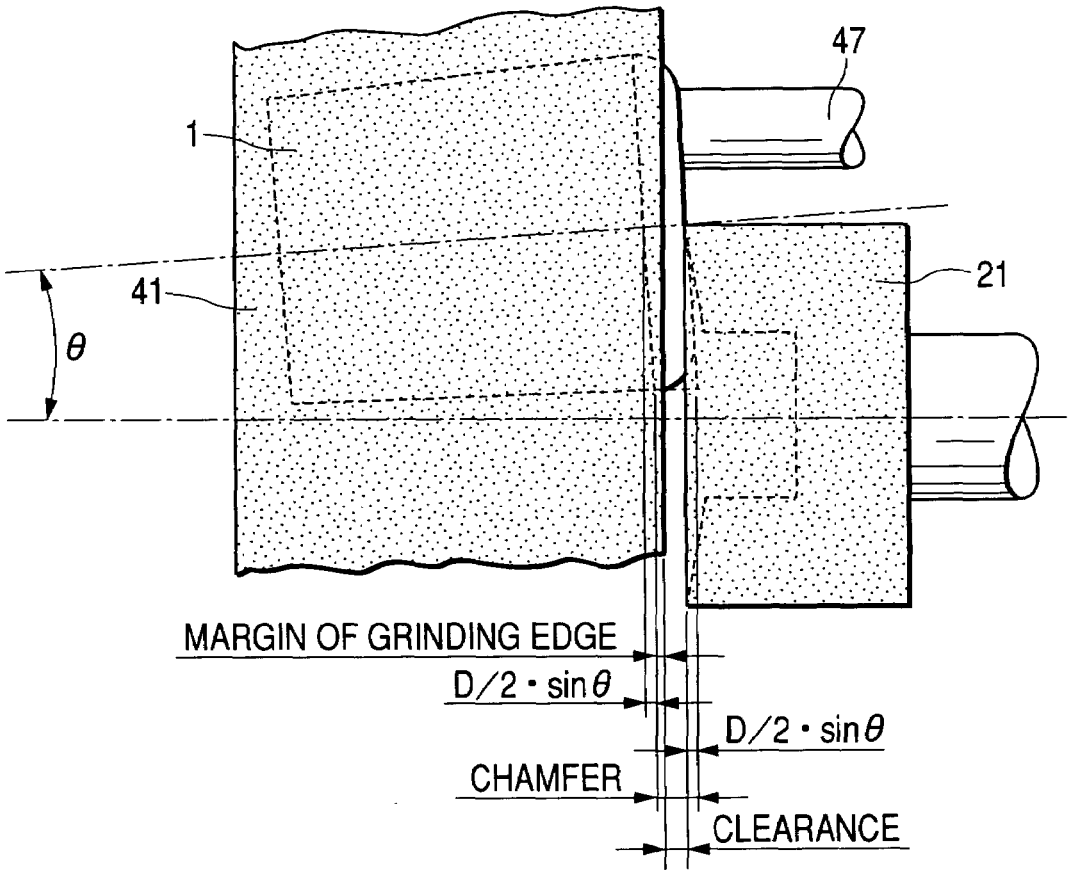
FIG. 6 is an enlarged diagram showing the main portion of the second embodiment.

FIG. 6 is a diagram seen from an arrow C direction in FIG. 5A. As described above, the extended line of the rotation axis of the work 1 crosses with the extended line of the rotation axis of the cup grinding wheel 21 (with a crossing angle θ). The crossing angle θ is set such that the distance from the crossing point to the end surface of the work 1 coincides with a radius of curvature of the end surface in order to obtain a desired radius of curvature of the end surface. Supposing that the diameter of the large diameter side end surface of the work 1 is D, a clearance with almost the following value, for example, can be secured between the outer diameter surface grinding wheel 41 and the cup grinding wheel 21.

$$\text{clearance}=\text{chamfer}+D/2\sin\theta-\text{margin of the grinding stone edge}-D/2\sin\theta=\text{the chamfer}-\text{the margin of the grinding stone edge}$$

Thus, a sufficient clearance can be secured between the outer diameter surface grinding wheel 41 and the cup grinding wheel 21.

Figure 7:
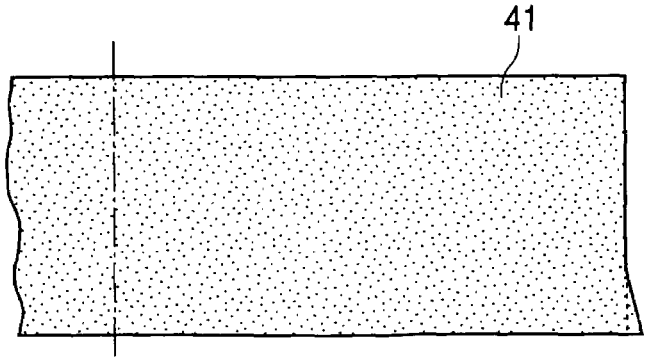
FIG. 7 is an enlarged diagram showing the main portion of the second embodiment.

A grinding portion abutting against the outer diameter surface grinding wheel 41 of the work 1 does not coincide with the mother line of the outer diameter surface of the work (the contour line of the outer diameter surface of the work in a projection view). Thus, the mother line shape of the outer diameter surface of the work 1 cannot be made linear by using the outer diameter surface grinding wheel having a linear mother line shape, and hence the outer diameter surface of the work 1 is configured in such a shape that its center portion is concave. In such a case, in order to make the outer diameter surface shape of the work 1 conical, the outer periphery of the outer diameter surface grinding wheel 41 is dressed so as to be configured in a hourglass-shape as shown in FIG. 7.

Figure 8:
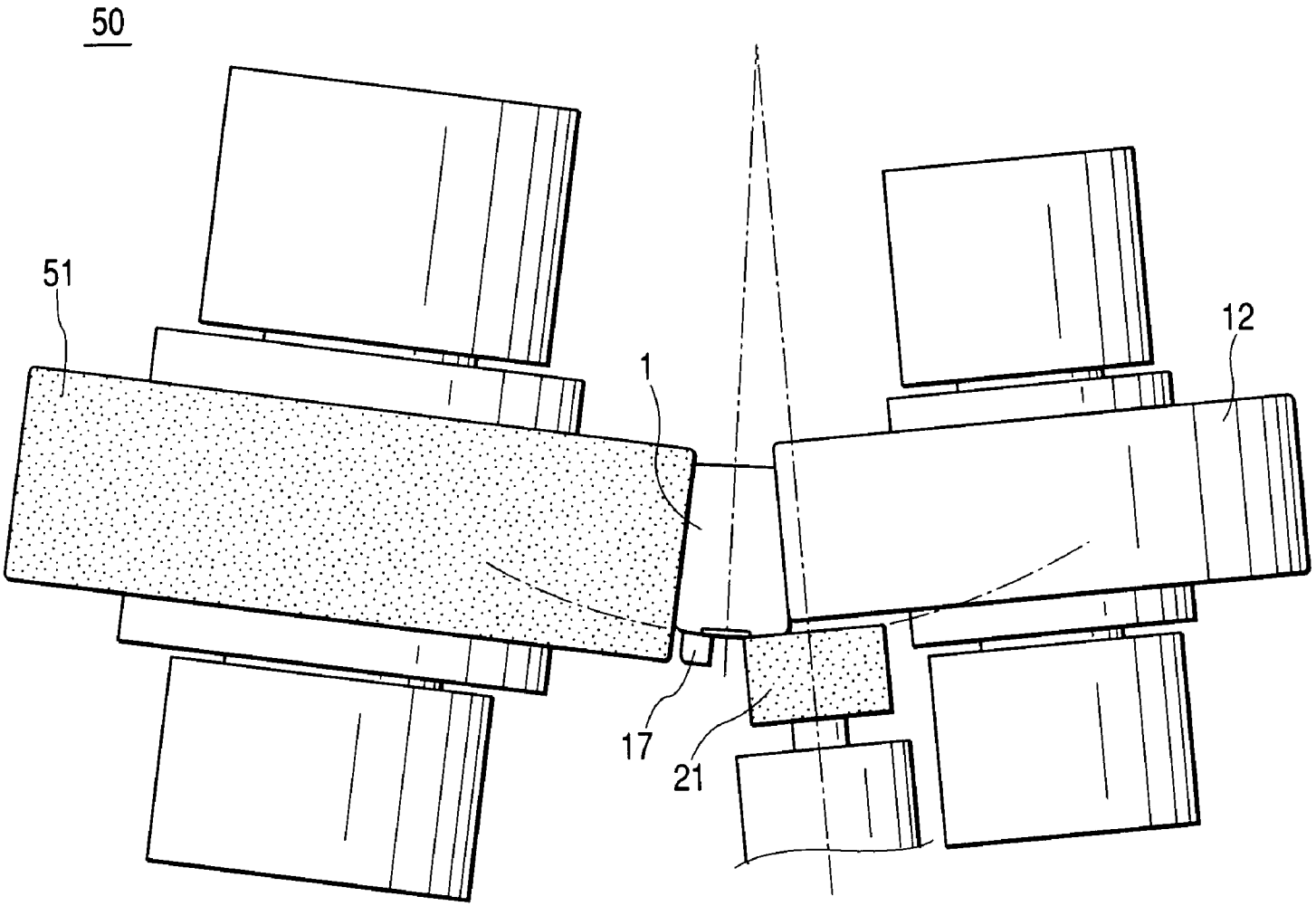
FIG. 8 is a schematic plan view showing a third embodiment.

Next, a centerless grinding apparatus 50 according to the third embodiment of the invention will be explained based on FIG. 8. Although this embodiment has almost the same configuration as the first embodiment, in this embodiment, the positions of a cup grinding wheel 21 and an end surface stopper 17 are opposite to those in the first embodiment. The end surface stopper 17 abuts against a portion closer to an outer diameter surface grinding wheel 51 of the large diameter side end surface of the work 1 thereby to support the end surface of the work 1. On the other hand, a cup grinding wheel 21 abuts against a portion closer to the regulating wheel 12 of the large diameter side end surface of the work 1, and in this state each of the work 1 and the cup grinding wheel 21 rotates thereby to grind the end surface of the work 1.

In this embodiment, also when the regulating wheel 12 is skewed, the regulating wheel applies to the work 1 a thrust force in the axial direction directed toward the end surface stopper 17 side thereby to urge the work 1 against the end surface stopper 17. In this state, the cup grinding wheel 21 grinds the end surface of the work 1.

Although the outer diameter surface grinding wheel 51 is required to contact with the entire surface of the work 1 which outer diameter surface is required to be ground, the regulating wheel 12 can be made narrow as long as the posture of the work 1 is made stable and a suitable driving force can be obtained. Thus, according to the embodiment, a clearance between the regulating wheel 12 and the cup grinding wheel 21 can be made large easily.

Usually, since the outer diameter surface grinding wheel 51 rotates in a downward posture and the work 1 also rotates in a downward posture. Thus, in the third embodiment, an upward friction force occurs on the end surface stopper 17, and this friction force serves to float the work 1 from the supporting blade. However, such a phenomenon does not raise any problem as long as the grinding condition is selected suitably.

Although the friction force becomes downward when the rotation directions of the work 1 and the outer diameter surface grinding wheel 51 are reversed, the operations change in such a manner that the grinding force becomes upward or the entering way of coolant to the grinding point changes.

Figure 9:
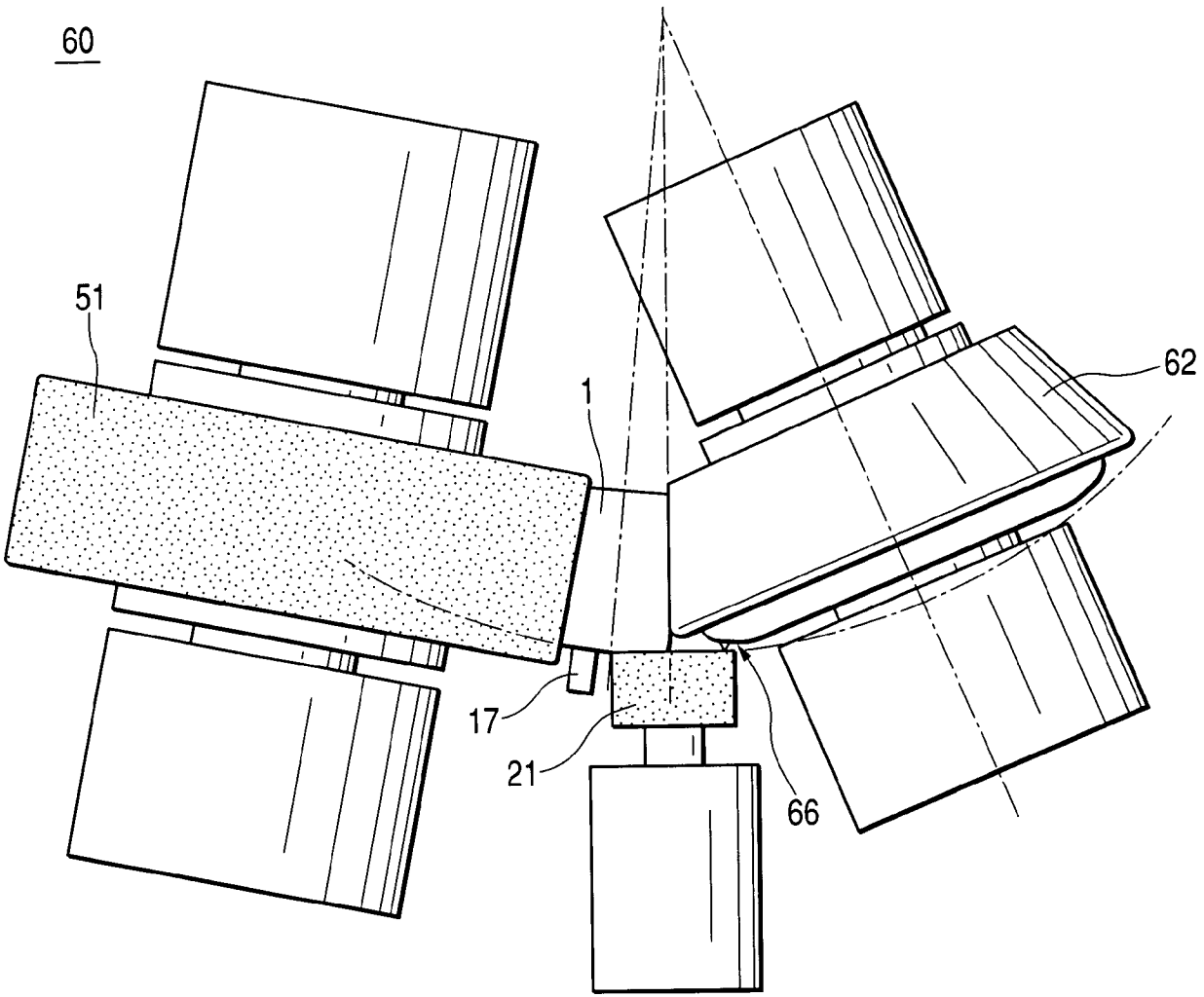
FIG. 9 is a schematic plan view showing a fourth embodiment.

Next, a centerless grinding apparatus 60 according to the fourth embodiment of the invention will be explained based on FIG. 9. Although this embodiment is almost same in its construction as the third embodiment, this embodiment differs from the third embodiment in that the outer periphery of a regulating wheel 62 is configured in a conical shape and a grinding wheel dressing diamond 66 is integrally provided at the outer diameter side end surface of the regulating wheel 62.

According to the embodiment, the extended line of the rotation axis of the regulating wheel 62 also crosses with the crossing point between the extended line of the rotation axis of a cup grinding wheel 21 and the extended line of the rotation axis of a work 1. When the regulating wheel 62 rotates around its rotation axis, the cup grinding wheel 21 can be dressed in a spherical shape by the grinding wheel dressing diamond 66.

Figure 10:
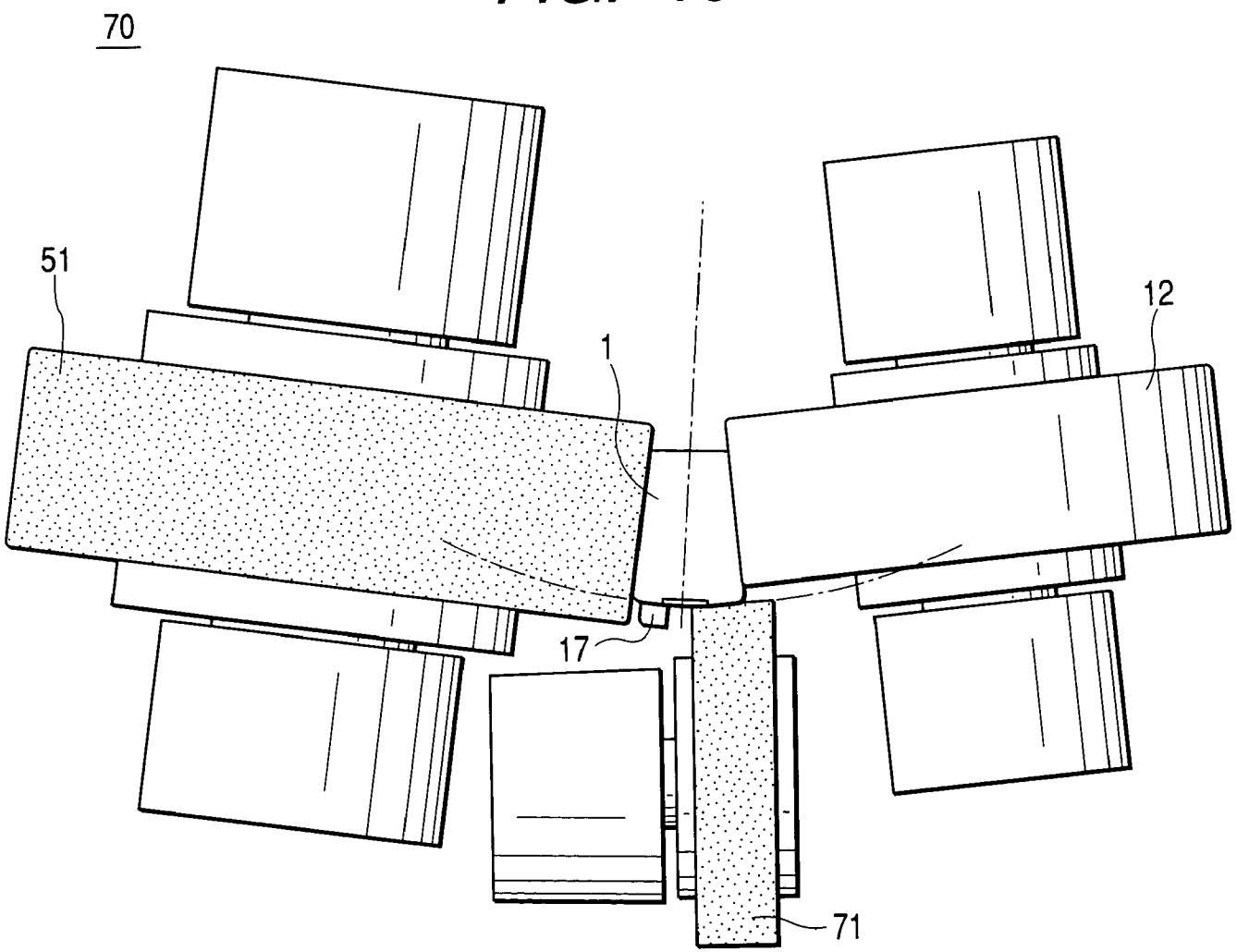
FIG. 10 is a schematic plan view showing a fifth embodiment.

Next, a centerless grinding apparatus 70 according to the fifth embodiment of the invention will be explained based on FIG. 10. Although this embodiment is almost same in its construction as the third embodiment, this embodiment differs from the third embodiment in that a disc-shaped grinding wheel 71 is used as the end surface grinding wheel in place of the cup grinding wheel. The end surface of the work 1 is ground by the outer periphery of the grinding wheel 71. When the outer periphery of the grinding wheel 71 is configured in a hourglass-shape, the end surface of the work 1 can also be ground in a spherical shape.

The invention is not limited to the aforesaid embodiments and suitable modification and improvement etc. may be performed.

Further, in place of loading the work from the inner side of the supporting blade 16 as shown in FIG. 4, the work may be loaded or unloaded from this side (the side where the end surface grinding wheel exists) in a state where the cup grinding wheel (the end surface grinding wheel) is moved aside.

The grinding condition may be selected so that the dressing of the cup grinding wheel for the end surface grinding can be eliminated, that is, the grinding wheel performs the autogenesis function. In this case, since the working surface position of the grinding wheel can not be detected mechanically, the constant-pressure grinding method or the grinding method based on the contact detection between the grinding wheel and the work is required.

The constant-pressure grinding method can be carried out in the following manner. That is, the work is ground in a manner that the grinding wheel is pressed against the work for a predetermined time period by using a cutting table with a grinding wheel spindle as a spring support so that the grinding wheel moves away from the work when a force of a predetermined pressure or more is applied to the grinding wheel. According to such a configuration, a desired grinding machining allowance or stock amount can be removed from the work based on the pressing force and the grinding time regardless of the position of the surface (operation surface) of the grinding wheel. The grinding force at this time is required to be selected to be smaller than the thrust force for pressing the work to the stopper.

The grinding method based on the contact detection between the grinding wheel and the work can be carried out in the following manner. That is, a contact detection means between the grinding wheel and the work is provided, and after the contact is detected during the cutting operation by the contact detection means, a predetermined amount is cut. Thus, even if the surface of the grinding wheel is uneven or the position of the grinding wheel is unknown, a desired grinding machining allowance can be removed from the work.

As described above, according to the invention, it is possible to provide the centerless grinding apparatus and a centerless grinding method which can simultaneously grind the outer diameter surface and the end surface of a substantially cylindrical work despite of a relatively simple configuration of the apparatus.

What is claimed is:

1. A centerless grinding apparatus, comprising:

an outer diameter surface grinding wheel for grinding an outer diameter surface of a work of a substantially cylindrical shape;

a regulating wheel for supporting the outer diameter surface of the work in conjunction with the outer diameter surface grinding wheel;

an end surface grinding wheel for grinding an end surface of the work, said end surface grinding wheel being a cup grinding wheel, wherein the end surface grinding wheel grinds the end surface of the work while the outer diameter surface grinding wheel grinds the outer diameter surface of the work in a state that the work is disposed between the outer diameter surface grinding wheel and the regulating wheel; and a clearance between said outer diameter surface grinding wheel and said end surface grinding wheel is set equal to a chamfer distance of the work minus ($D/2 \cdot \sin \theta$) minus a margin of the outer diameter surface grinding wheel edge, wherein:

D is a diameter of an end surface of the work; and $\theta$ is a crossing angle between a rotation axis of the work and a rotation axis of the end surface grinding wheel, wherein the rotation axis of the work and the rotation axis of the end surface grinding wheel cross at a crossing point such that a distance from the crossing point to the end surface of the work coincides with a radius of curvature of the end surface.

2. The centerless grinding apparatus according to claim 1, wherein the outer diameter surface grinding wheel is formed in a disc shape, and the outer diameter surface of the work is ground by an outer periphery of the outer diameter surface grinding wheel.

3. The centerless grinding apparatus according to claim 1, wherein the cup grinding wheel grinds the end surface of the work while avoiding interference with the outer diameter surface grinding wheel.

4. The centerless grinding apparatus according to claim 3, wherein the cup grinding wheel is disposed in a manner that an extended line of a rotation axis of the cup grinding wheel crosses with an extended line of a rotation axis of the work in a state of being supported between the outer diameter surface grinding wheel and the regulating wheel thereby to grind the end surface of the work in a spherical shape.

5. The centerless grinding apparatus according to claim 3, further comprising a dressing device for dressing the cup grinding wheel in a tapered shape or a spherical shape.

6. The centerless grinding apparatus according to claim 1, wherein the regulating wheel applies to the work a thrust force directed toward the end surface grinding wheel while supporting the outer diameter surface of the work in conjunction with the outer diameter surface grinding wheel.

7. The centerless grinding apparatus according to claim 1, wherein the regulating wheel is disposed opposite to the outer diameter surface grinding wheel so as to define therebetween a space for sandwiching the work.

* * * * *